US007942377B2

(12) United States Patent
Harold et al.

(10) Patent No.: US 7,942,377 B2
(45) Date of Patent: May 17, 2011

(54) BEACH UMBRELLA STAND INCLUDING FOOT OPERATED DRIVE ASSEMBLY FOR ANCHORING AND METHOD OF USE

(75) Inventors: Robert Harold, Southampton, PA (US); John Sperry, Feasterville, PA (US)

(73) Assignee: H & S Endeavors, LLC, Southampton, PA (US)

( * ) Notice: Subject to any disclaimer, the term of this patent is extended or adjusted under 35 U.S.C. 154(b) by 0 days.

(21) Appl. No.: 12/404,791

(22) Filed: Mar. 16, 2009

(65) Prior Publication Data

US 2009/0309004 A1 Dec. 17, 2009

Related U.S. Application Data

(63) Continuation of application No. 11/766,918, filed on Jun. 22, 2007, now Pat. No. 7,503,541, which is a continuation of application No. 11/297,761, filed on Dec. 8, 2005, now Pat. No. 7,246,783.

(51) Int. Cl.
*F16M 13/00* (2006.01)

(52) U.S. Cl. ..... 248/545; 135/16; 248/156; 248/522; 248/530

(58) Field of Classification Search ..... 248/545, 248/156, 522, 530, 533; 135/16; 52/157
See application file for complete search history.

(56) References Cited

U.S. PATENT DOCUMENTS

| | | | | |
|---|---|---|---|---|
| 1,388,923 | A | | 8/1921 | Bullard |
| 1,583,409 | A | | 5/1926 | Marquart |
| 2,193,984 | A | | 3/1940 | Rhinevault |
| 2,211,283 | A | | 8/1940 | Mercer |
| 2,441,109 | A | * | 5/1948 | Carlson ..... 403/86 |
| 2,633,317 | A | | 3/1953 | Marsh |
| 2,803,980 | A | | 8/1957 | Vogel |
| 3,011,597 | A | | 12/1961 | Galloway et al. |
| 3,318,560 | A | * | 5/1967 | Garrette, Jr. et al. ..... 248/545 |
| 3,575,069 | A | | 4/1971 | White |
| 4,131,122 | A | | 12/1978 | Brooks |
| 4,832,304 | A | | 5/1989 | Morgulis |
| 4,836,231 | A | | 6/1989 | Peterson |
| 4,850,564 | A | | 7/1989 | Padin |
| 4,920,897 | A | | 5/1990 | Reed et al. |
| 5,046,699 | A | | 9/1991 | Perreault et al. |
| 5,067,683 | A | | 11/1991 | Wager |
| 5,122,014 | A | | 6/1992 | Genfan |
| 5,143,108 | A | | 9/1992 | Kenney |
| 5,152,495 | A | | 10/1992 | Jacinto et al. |
| 5,156,369 | A | | 10/1992 | Tizzoni |
| 5,199,361 | A | | 4/1993 | Robinson |
| 5,358,209 | A | | 10/1994 | Ward |
| 5,396,916 | A | * | 3/1995 | Boissonnault ..... 135/16 |
| 5,482,246 | A | | 1/1996 | Derkoski |
| 5,488,798 | A | * | 2/1996 | Beachel ..... 43/21.2 |
| 5,906,077 | A | | 5/1999 | Andiarena |
| 6,199,569 | B1 | | 3/2001 | Gibson |
| D454,682 | S | | 3/2002 | D'Andrea |

(Continued)

*Primary Examiner* — Ramon O Ramirez
(74) *Attorney, Agent, or Firm* — Volpe and Koenig, P.C.

(57) ABSTRACT

A beach umbrella stand is provided including a foot operated drive assembly. A pole of a beach umbrella stand has a hollow interior portion housing the foot operated drive assembly. The foot operated drive assembly includes a ratchet assembly operated by a foot pedal. The ratchet assembly further includes an auger mounted at least partially within the pole, for driving into the sand. The ratchet assembly is positioned for operation of a pedal by a user's foot.

9 Claims, 10 Drawing Sheets

U.S. PATENT DOCUMENTS

| | | | |
|---|---|---|---|
| D456,131 | S | 4/2002 | Dotson, Jr. |
| 6,412,748 | B1 | 7/2002 | Girard |
| 6,443,172 | B2 | 9/2002 | Brumfield |
| 6,524,047 | B2 | 2/2003 | Erdoes et al. |
| 6,547,203 | B1 | 4/2003 | Willard |
| 6,631,527 | B2 | 10/2003 | Hyduk |
| 6,668,750 | B1 | 12/2003 | Walz et al. |
| 6,675,819 | B2 | 1/2004 | Arrowood et al. |
| 6,895,884 | B1 | 5/2005 | Velazquez |
| 6,908,067 | B2 | 6/2005 | Clasen |
| 2002/0175262 | A1 | 11/2002 | Brooks, III |
| 2004/0177875 | A1 | 9/2004 | Brooks, III |
| 2005/0040297 | A1 | 2/2005 | Saraf |
| 2006/0032522 | A1* | 2/2006 | Brooks, III ..... 135/16 |

* cited by examiner

BEACH UMBRELLA STAND INCLUDING FOOT OPERATED DRIVE ASSEMBLY FOR ANCHORING AND METHOD OF USE

CROSS REFERENCE TO RELATED APPLICATIONS

This application is a continuation of and claims priority to U.S. patent application Ser. No. 11/766,918, filed Jun. 22, 2007, now U.S. Pat. No. 7,503,541, issued Mar. 17, 2009, which is a continuation of and claims priority to U.S. patent application Ser. No. 11/297,761, filed Dec. 8, 2005, now U.S. Pat. No. 7,246,783, issued Jul. 24, 2007, each of which is hereby incorporated by reference herein as if fully set forth in their entirety.

FIELD OF INVENTION

The present invention relates generally, to the field of devices for assisting in securing and/or anchoring poles such as umbrella stands into loose dirt or sand.

BACKGROUND

One of the main accessories people take with them to the beach is a beach umbrella for providing shade, which normally includes a one or two-piece pole or stand having a pointed end. Many beachgoers consider a shaded area necessary when vacationing or visiting a beach area.

One problem with known beach umbrellas and breach umbrella stands is that it is difficult to insert the stand in the sand. With the known beach umbrella stands having a point or spike at the bottom, the stand must be pressed or wound into the sand, usually in a circular motion. This not only requires a great deal of user strength, but also generally creates a hole that must be back filled with sand once the stand is driven to the desired depth. This arrangement generally creates for a non-stable support, and the stand can easily be tipped or pulled out of the sand when the wind blows on the umbrella.

Other known solutions involve hand cranks turning an auger or drill-bit type of spike provided at the bottom of the stand into the sand. Such arrangements also require a great deal of hand strength, and cannot be used by, for example, senior adults or persons with weakened hand strength.

Thus, there is the need for an umbrella stand that can easily be secured in the sand by a person wishing to set up and/or use a beach umbrella attached to the stand.

SUMMARY OF THE INVENTION

A beach umbrella stand according to the present invention includes a foot operated drive assembly. The foot operated drive assembly is housed at least partially within a pole including a hollow interior portion. An auger is mounted at least partially within the hollow interior portion of the pole, and the auger is adapted to rotate about a central axis. An auger gear is provided at an upper portion of the auger. At least a portion of the auger protrudes from the bottom of the pole.

A ratchet assembly is mounted at least partially within the hollow interior portion of the pole. The ratchet assembly is positioned for operation by a user's foot. The ratchet assembly includes a drive gear that is in engagement with the auger gear. The drive gear adapted to rotate the auger gear when the drive gear is rotated. A foot pedal is provided for engaging the ratchet assembly, whereby actuation of the foot pedal by a user turns the drive gear. The drive gear turns the auger gear, thereby turning the auger. The auger is driven into the ground (sand, soil, dirt, earth) by the foot operation of the pedal. The foot operated drive assembly of the present invention is easily operated by a user without the need for a great deal of physical strength, and provides for a securely anchored pole.

DETAILED DESCRIPTION OF THE PREFERRED EMBODIMENTS

Figure 1:
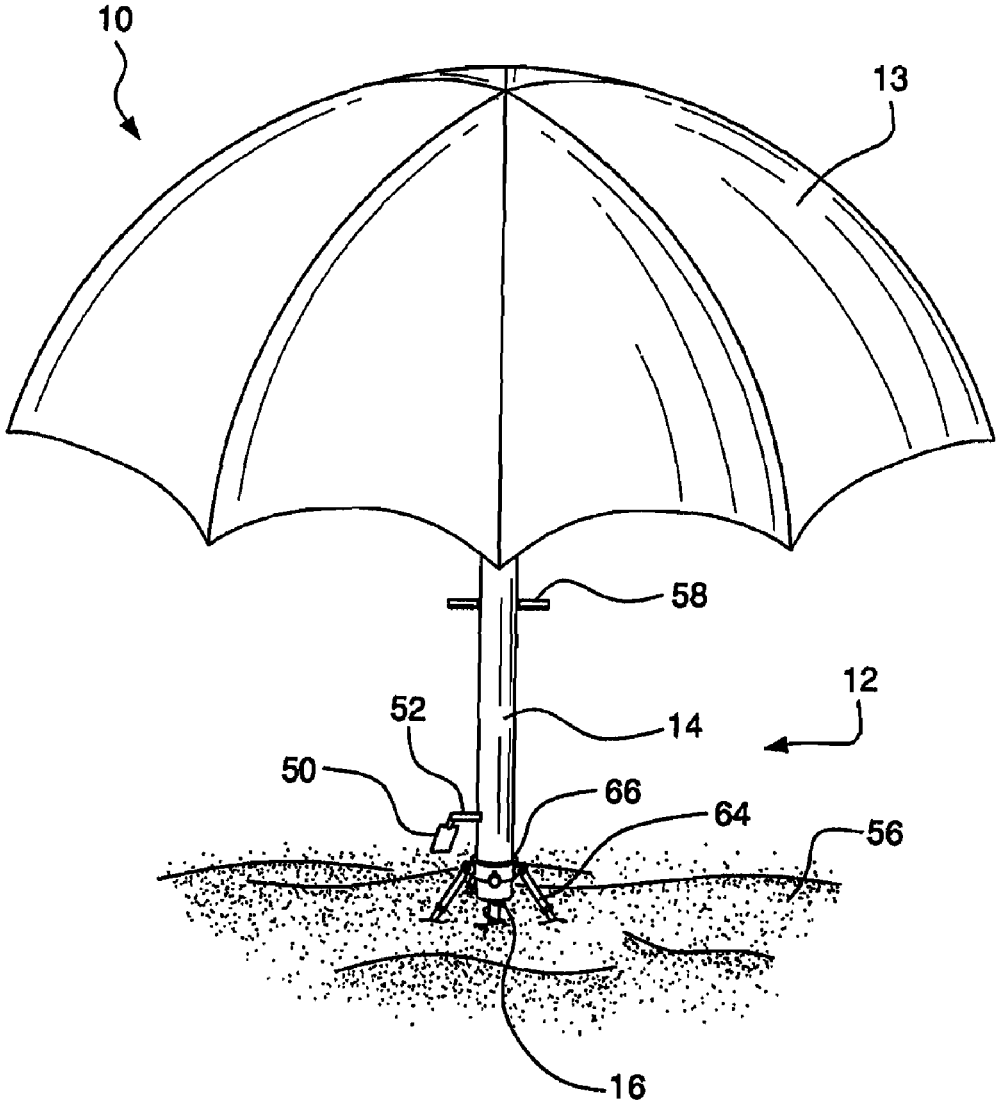
FIG. 1 shows a side elevational view of a beach umbrella stand having a foot operated assembly according to the present invention.
Figure 2:
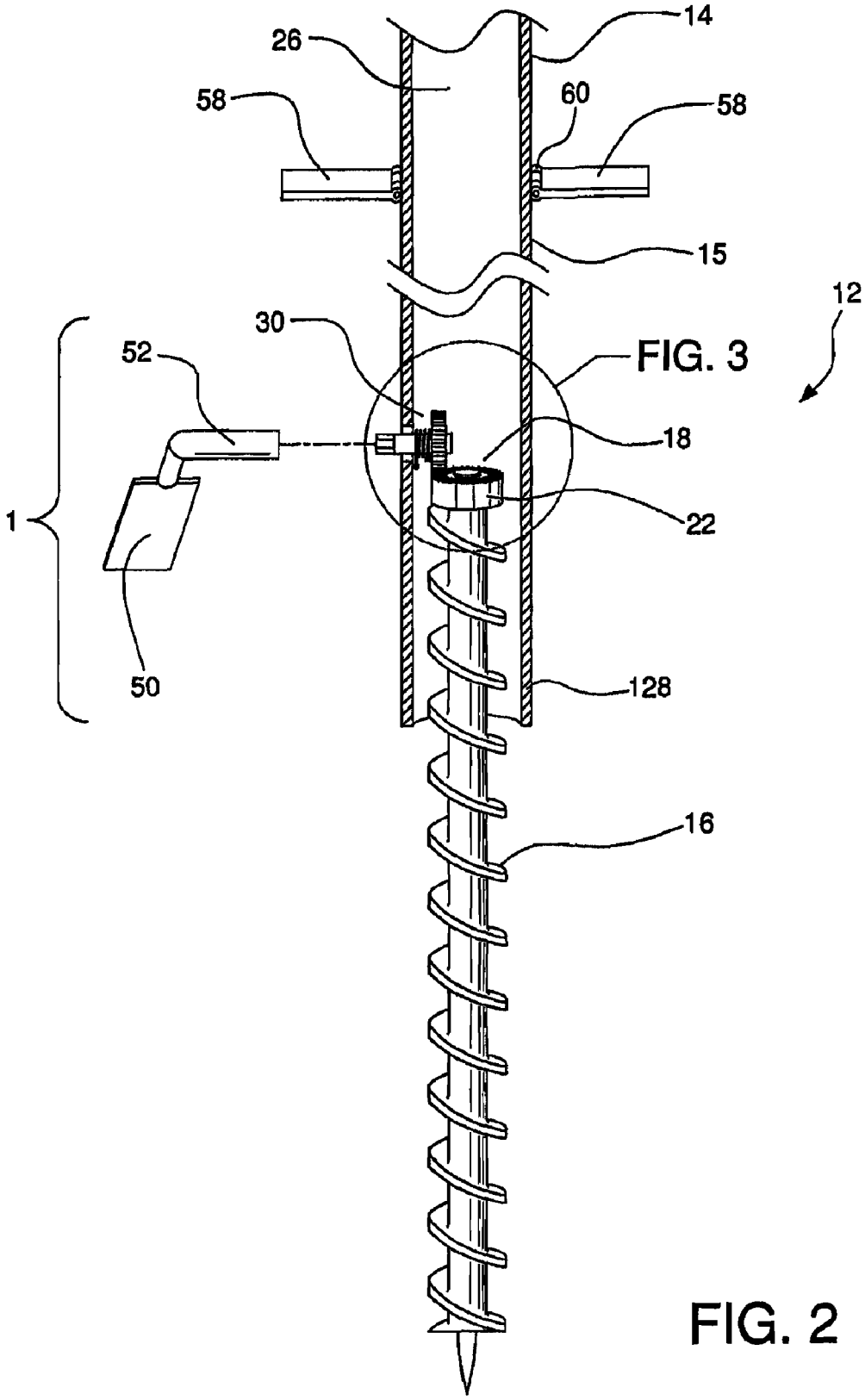
FIG. 2 shows a cross sectional view of an embodiment of the umbrella stand according to the present invention.

FIGS. 1-5 show an embodiment of the foot operated drive assembly 1 for a beach umbrella stand 12 according to the present invention. The beach umbrella 10 is provided with an umbrella 13 at its upper end, and includes a beach umbrella stand 12 that may be formed as a one or two piece pole 14. The pole 14 is at least partially hollow, with a pole wall 15 defining an interior space 26, for housing at least some of the elements of the present invention. As shown in FIG. 2, the interior space 26 of the pole 14 at least partially houses an auger 16, that extends at least partially within the pole 14 and exits the pole 14 adjacent the bottom end 128 of the pole 14. The auger 16 may be provided as any type of spike or shaft having a portion provided as a threaded shank capable of being turned and embedding itself into, for example, sand 56 at a beach. The lower portion 20 of the auger 16 is preferably provided as a spike or pointed end. The upper portion 18 of the auger 16 is preferably provided with an auger gear 28 adjacent the upper portion 18, as described in greater detail below.

Figure 3:
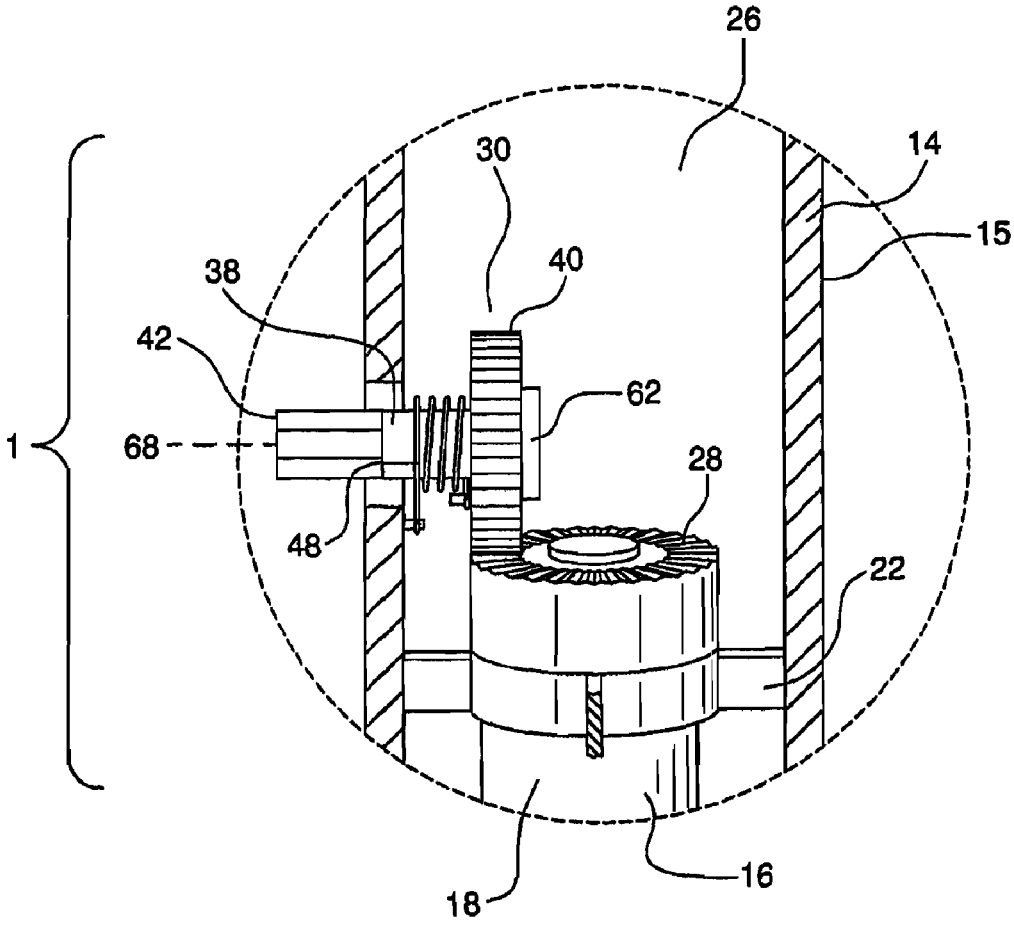
FIG. 3 shows a close-up cross sectional view of the umbrella stand of FIG. 2 according to the present invention.
Figure 4:
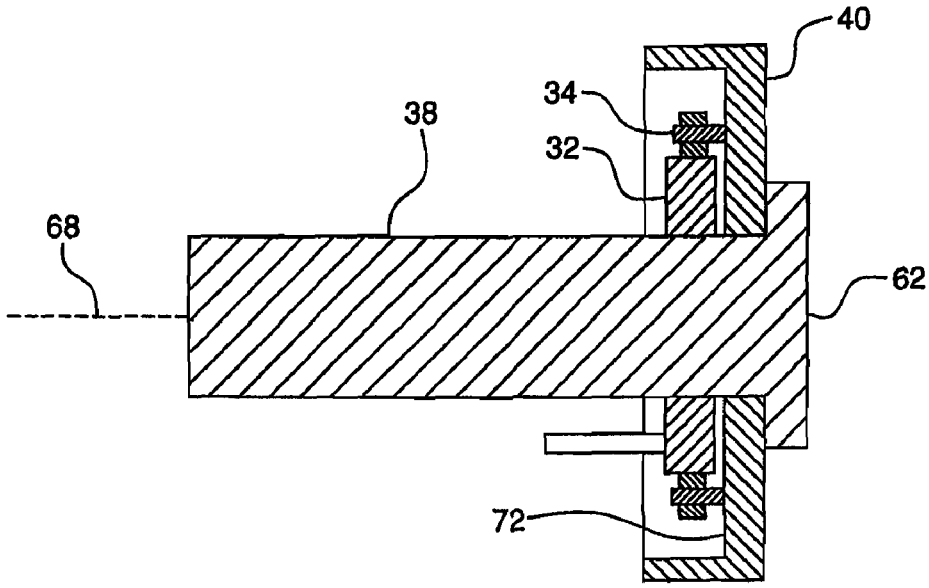
FIG. 4 is a cross-sectional side view of a ratchet assembly according to an embodiment of the present invention.

As shown in detail in FIG. 3, the auger 16 is supported at its upper portion 18 within the pole 14 by at least one internal collar 22. The upper portion 18 of the auger 16 is sized to be larger than the diameter of the collar 22. While supported by at least one collar 22, the auger 16 is free to rotate about its central longitudinal axis 24, while being maintained in position by the collar 22. It is appreciated that several collars 22 may be provided along the interior space 26 of the pole 14, providing added stability to the auger 16.

As shown in FIGS. 3-10, a foot operated drive assembly 1 of the present invention includes a ratchet assembly 30 that is provided at least partially within the interior space 26 of the pole 14 adjacent the upper portion 18 of the auger 16. The ratchet assembly 30 is mounted at least partially within the pole 14, such as by a bracket, collar, or other means (not shown). The ratchet assembly 30 includes a drive gear 40 rotatably mounted about a drive shaft 38. The drive shaft 38 is adapted to rotate about a central axis 68. The drive gear 40 is held on the drive shaft 38 such as by a pin 62, and is freely rotatable about the drive shaft 38. A first spring biased pawl 34 is mounted on the outer side 72 of the drive gear 40, held by a shaft 75. A second spring biased pawl 74 may be mounted at another position on the outer side 72 of the drive gear 40, held by a shaft 75. In a preferred embodiment, the second spring biased pawl 74 is mounted opposite the first spring biased pawl 34.

Figure 5:
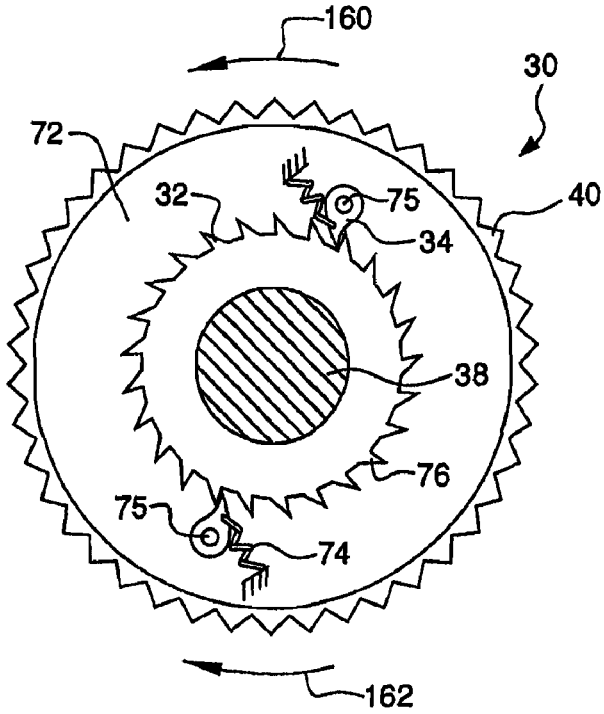
FIG. 5 is a cross-sectional front view of a ratchet assembly according to an embodiment of the present invention.

A toothed wheel 32 is fixedly mounted on the drive shaft 38, and is rotatable with the drive shaft 38. The toothed wheel 32 is adapted to rotate when the drive shaft 38 is rotated. As is the case with common ratchet assemblies, each of the teeth 76 are sloped in one direction, so that the teeth 76 will engage the first spring biased pawl 34 and the second spring biased pawl 74 when the drive shaft 38 is rotated in one direction. In the illustrated examples, when facing the beach umbrella stand from the outside of the pole 14, the teeth 76 will engage the first spring biased pawl 34 and the second spring biased pawl 74 when the drive shaft 38 is rotated in the counter-clockwise direction, as shown by the upper arrow 160 in FIG. 5. When the drive shaft 38 is rotated in the opposite direction, as shown by the lower arrow 162 of FIG. 5 (clockwise, as shown in FIG. 5), the pawls 34, 74 will pass over the teeth 76. Thus, in the illustrated exampled, and as shown in detail in FIG. 5, when the drive shaft 38 is rotated counter-clockwise, as viewed facing the drive shaft 38 from outside of the pole 14, the drive shaft 38 will rotate the toothed wheel 32, and at least one of the teeth 76 of the toothed wheel 32 will engaged the first spring biased pawl 34 and/or the second spring biased pawl 74, thereby turning the drive gear 40. This rotation will in turn rotate the auger gear 28, thereby rotating the auger 16, and "drilling" the auger 16 into the sand 56.

In a preferred embodiment, the drive shaft 38 is to be turned in a counter-clockwise direction (when facing the drive shaft from the outside of the pole 14) for securing the umbrella stand 12 in the sand, as shown by the upper arrow 160 in FIG. 5. A spring 48 is provided, having one end coupled to drive shaft 38, and another end coupled to the inner side of the pole 14, such that the spring 48 biases the drive shaft 38 opposite the direction the drive shaft 38 rotates to drive the auger 16 into the sand 56, that is, clockwise as shown in the illustrated example, in particular the lower arrow 162 shown in FIG. 5. Thus, when the spring 48 rotates the drive gear 40, the toothed wheel 32 will turn without catching the first spring biased pawl 34 or the second spring biased pawl 74. It is contemplated that any ratchet system may be used to control the movement of the drive gear 40, and those in the art would appreciate various ratchet arrangements that may be used as the ratchet assembly 30. It is appreciated that the spring 48 can be positioned and secured in any arrangement whereby the spring 48 biases the drive shaft 38 and/or toothed wheel 32 in a direction where the pawls 34, 74 will pass over the teeth 76.

In addition, it is appreciated that the orientation of the drive shaft 38, drive gear 40, auger 16, auger gear 28, toothed wheel 32, teeth 76, spring 48, and threads of the auger may all be rearranged so that, for example, turning the drive shaft 38 clockwise will drive the auger 16 into the sand 56, and the spring 48 will in such an alternate arrangement will bias the drive shaft 38 in the counter-clockwise direction. Such an alternate arrangement would essentially be a mirror image of FIGS. 1-5.

An end of the drive shaft 38 is provided as a bolt end 42. The bolt end 42 may be formed as a square, or a hex arrangement, or any other end arrangement capable of engaging a pedal, as discussed in greater detail below. In the preferred embodiment, the bolt end 42 is a hex arrangement, which is preferably in the shape of a standard a hexagonal bolt head. In one embodiment of the present invention, as shown in FIGS. 2-3, the bolt end 42 extends from the interior 26, through an aperture 44 in the pole 14. In another embodiment, the bolt end 42 is provided within the interior 26, adjacent aperture 44.

Figure 6:
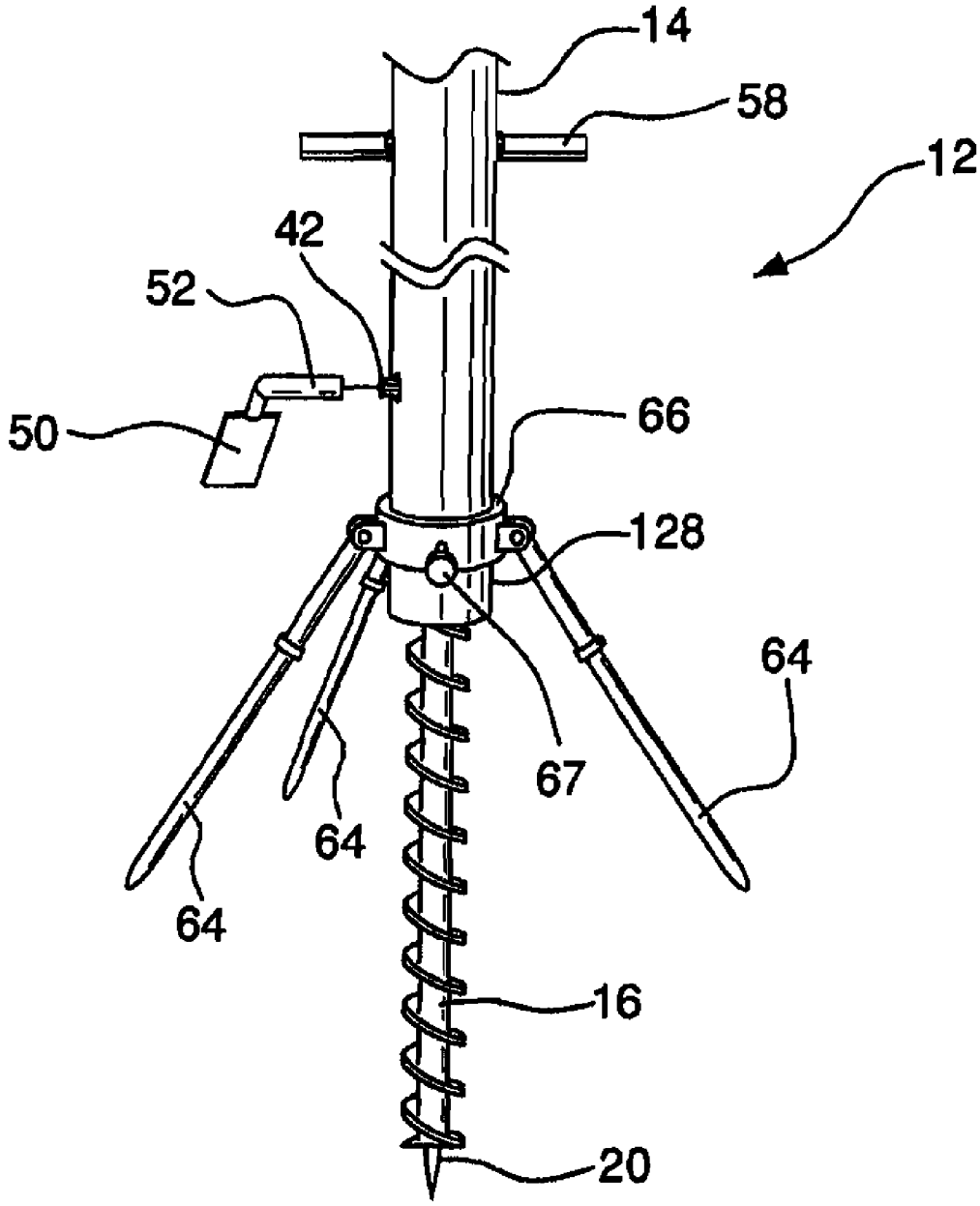
FIG. 6 is a side elevational view of another embodiment of the umbrella stand according to the present invention.

As shown in FIGS. 1, 2 and 6, a foot pedal 50 is provided, including a pedal extension 52. The pedal extension 52 includes a shaped opening 54, sized and shaped to engage the bolt end 42 of the drive shaft 38. In operation, the pedal extension 52 is engaged with the bolt end 42. A person seeking to secure the umbrella stand 12 in the sand, places their foot on the pedal 50, and actuates the pedal by placing their weight on it or otherwise pressing the foot pedal 50. Actuating the foot pedal 50, such as when a user steps on the pedal 50 and applies their weight, will rotate the drive shaft 38, which will in turn rotate the drive gear 49, which will in turn rotate the auger gear 28. The auger 16 will rotate about its central axis 24 in the direction indicated by arrow in FIG. 5. As the auger 16 rotates, it will be driven into the sand 56. The spring 48 will rotate the drive shaft 38 in the clockwise direction (shown by the bottom arrow of FIG. 5), thereby "ratcheting" the drive shaft 38 for additional operation of the pedal 50 by a user, until the beach umbrella stand 12 is drilled into the sand 56 to a preferred degree to prevent the beach umbrella stand 12 from being pulled out of the sand 56, such as by the wind.

The ratchet assembly 30 is positioned to provide access by the foot of a user, so that a user can use their weight to assist in operating the pedals 50, 106, and without the user having to raise their leg in an uncomfortable manner. Thus, it is preferred that the ratchet assembly 30 be positioned no higher than approximately about two (2) feet from the bottom end 128 of the pole 14. The height at which the ratchet assembly is positioned may be adjusted to accommodate users of varying heights. Preferably, the ratchet assembly 30 is positioned so that a user's knee is not raised above the user's waste when the user raised their foot to operate the pedals 50, 106.

To assist in driving the auger 16 into the sand 56, an umbrella stand 12 of the present invention may be provided with handles 58, as shown in FIGS. 1, 2 and 6. The handles 58 may be adapted to rest against the pole 14 when not is use, and to rotate about hinges 60 and releasably lock into place for providing balance and for while a person is operating the pedal 50.

To assist in providing stability to the beach umbrella 10 when the auger 16 is driven into the sand, telescoping legs 64, shown in FIG. 6, are preferably provided for creating a stable base respective to the surface of the sand. An adjustable collar 66 is providing sized to fit around the outside of the pole 14. The positioning of the collar 66 can be adjusted by adjusting the collar 66 along the pole 14 at a user-selected height, and by a tightening or loosening a connector such as, for example, a set screw 67. In a preferred embodiment, three legs 64 are provided to form a stable base. The length of each telescoping leg 64 can be adjusted by a user.

Figure 7:
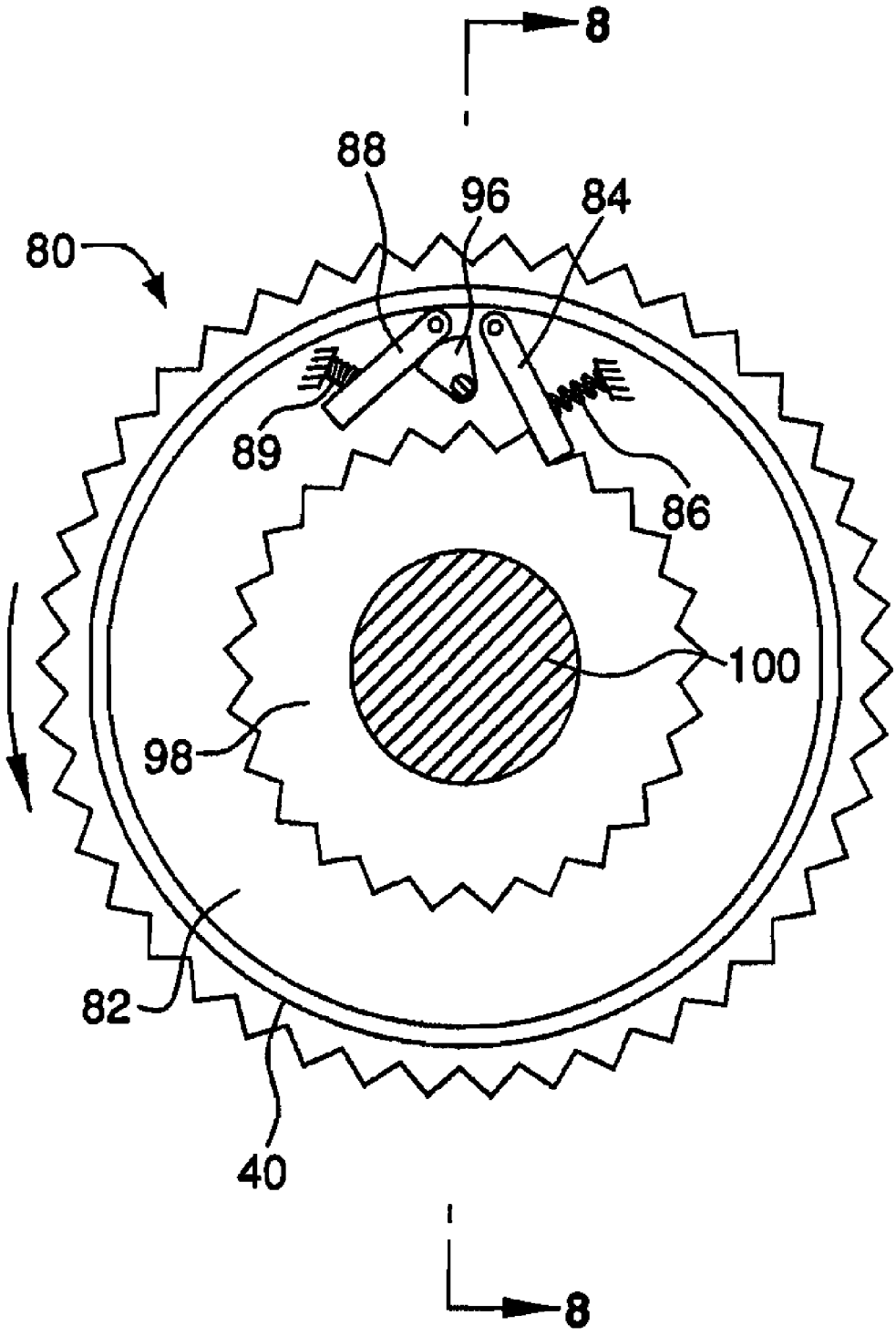
FIG. 7 is a cross-sectional front view of an alternate embodiment of a ratchet assembly according to another embodiment of the present invention.
Figure 8:
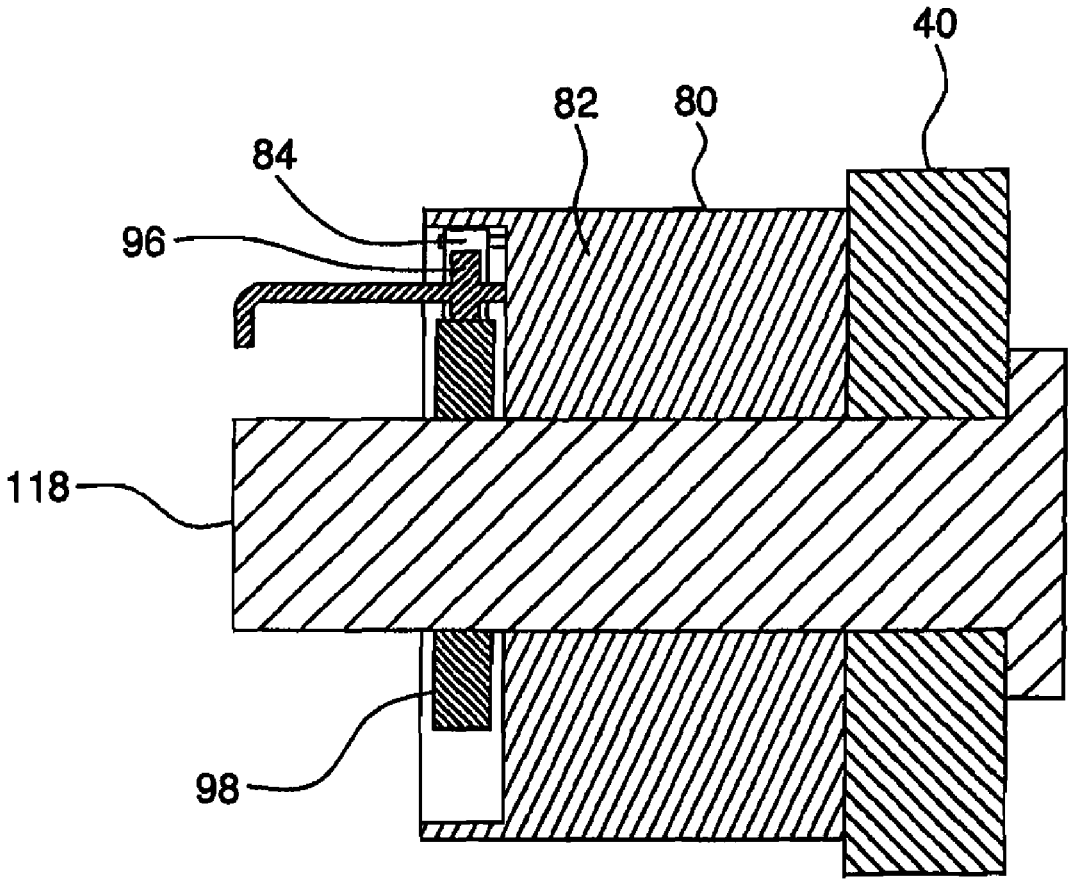
FIG. 8 is a cross-sectional side view of the ratchet assembly of FIG. 7.

An alternate ratchet assembly may be provided as a reversible ratchet assembly 80, as shown in FIGS. 7 and 8. In this embodiment, the drive gear 40 has an elongated body 82, extending adjacent the pole wall 15. A first spring loaded pawl 84 having a spring 86 and a second spring loaded pawl 88 having a spring 88 are mounted on the outer surface 92 of the elongated body 82, adjacent an opening 94 in the pole wall 15. A switch 96 is accessible through the opening 94. The switch 96 is moveable, and is adapted to contact and move the first spring loaded pawl 84 and the second spring loaded pawl 88 against the spring bias.

A drive shaft 100 extends through the drive gear 40 and elongated body 82, whereby the drive gear 40 and elongated body 82 are free to rotate about the drive shaft 100. The drive shaft 100 has a bolt end 110 extending from an opening 112 in the pole 14. A toothed wheel 98 is mounted about the drive shaft 100, and rotates with the drive shaft 100. The toothed wheel has teeth 102 which are positioned to engage one of the first spring loaded pawl 84 and the second spring loaded pawl 88.

The switch 96 may be moved from a first position 104, shown in FIG. 7, to a second position. In the first position, the switch 96 biases the first spring loaded pawl 84 away from the toothed wheel 98, against the bias of the spring 86. With the switch 96 in this position, the drive shaft 100 will contact and engage the second spring loaded pawl 88 when the drive shaft 100 is turned in the clockwise direction as shown in FIG. 7, and turn freely in the opposite direction. This movement will rotate the elongate body 82 and the drive gear 40. The drive gear 40 will engage the auger gear 28, and turn the auger 16 in a clockwise rotation (facing downward), which will assist in driving the auger 16 into the sand 56. It is contemplated that any reversible ratchet system may be used to control the movement of the drive gear 40, and those in the art would appreciate various reversible ratchet arrangements.

Figure 9:
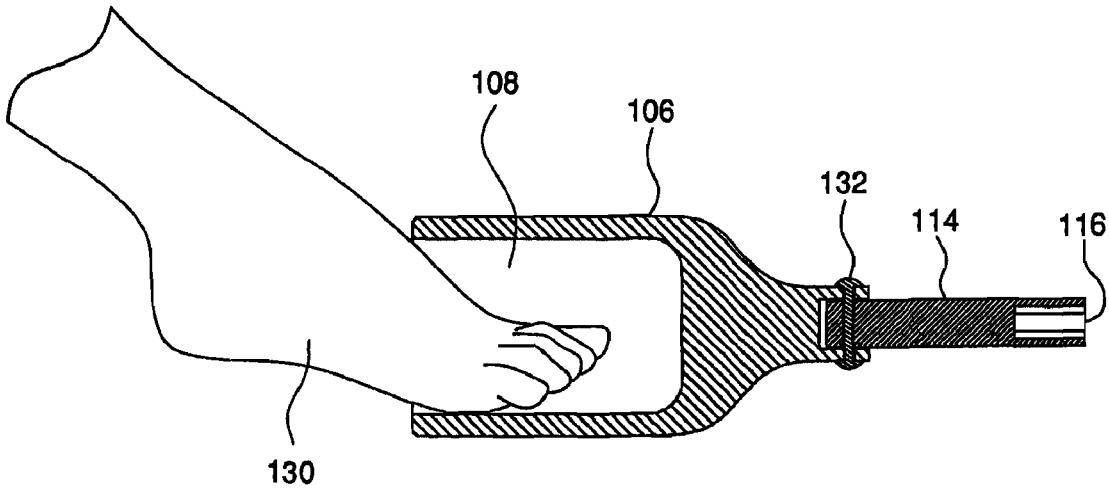
FIG. 9 is a side cross sectional view of a foot pedal according to one embodiment of the present invention.
Figure 10:
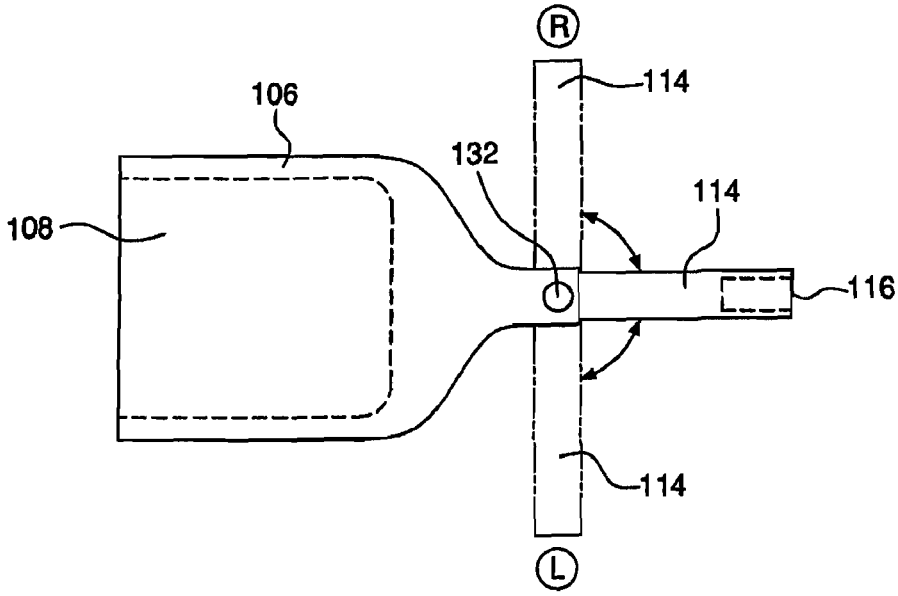
FIG. 10 is a top view of the foot pedal of FIG. 9.
Figure 12:
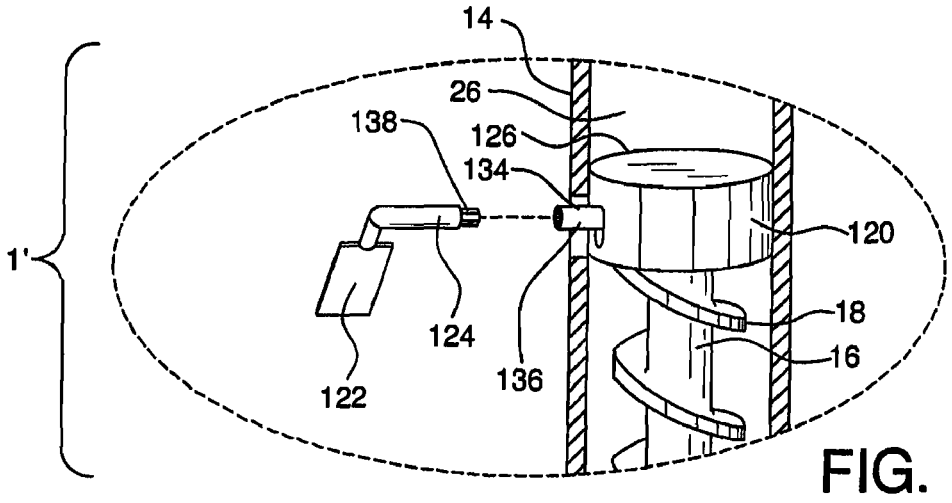
FIG. 12 is a close-up partial cross-sectional view of an embodiment of the umbrella stand according to the present invention shown in FIG. 9.

As shown in FIGS. 9 and 10, a foot pedal 106 may be formed having a receiving opening 108 for receiving a user's foot 130. The foot pedal 106 had an extension 114, having an opening 116 shaped and sized to engage the bolt end 110. The foot pedal extension 114 be connected to the foot pedal 106 by a hinge 132, allowing a right-sided position "R" and a left-sided position "L", as shown in FIG. 12. In this arrangement, a user can use the foot pedal 106 for either driving in or removing the auger 16 from the sand 56 with a downward motion, depending on the position of the switch 96.

By utilizing the reversible ratchet assembly 80, a user can operate the foot pedal 106 to either assist in driving the umbrella stand 12 into the sand 60, or for assisting in removing the umbrella stand 12 from the sand. For example, setting the switch 96 to the first position 104, the user may engage the pedal 106, having the extension 114 extending to the right looking down at the pedal 106, with the bolt end 110. By placing the user's foot into the opening 108 in the foot pedal 106 and pressing down with the user's foot, the auger 16 will turn clockwise, and wind itself into the sand. By raising the user's foot while it is in the pedal 106, the drive shaft 100 will turn in the opposite direction. However, the drive gear 40 will not turn in the opposite direction due to the pawl arrangement when the switch 96 is in the first position.

As can be appreciated, the switch 96 is moveable to a second position, moving the second spring loaded pawl 88 away from the toothed wheel 98, and allows the first spring loaded pawl 84 to be biased by spring 86 to engage the teeth 102. In this arrangement, when the drive shaft 100 is turned in the clockwise direction, the auger 16 will be turned in the clockwise direction, thus "unwinding" the auger 16 and the umbrella stand 12 from the sand 56. In this manner, the present invention provides assistance in removing a beach umbrella stand 12 from the sand 56, not only securing the beach umbrella in the stand. The foot pedal 106 can be arranged so that the extension 114 can be moved from a right-sided position, to a left-sided position, as shown in FIG. 12. In this manner, the foot pedal 106 can be moved to opposition sides when engaging the bolt end 110, allowing a user's downward movement and weight to act as the driving force for turning the auger 16 in either direction, regardless of whether the umbrella stand 12 is being secured into the sand 56, or removed from the sand 56.

Figure 11:
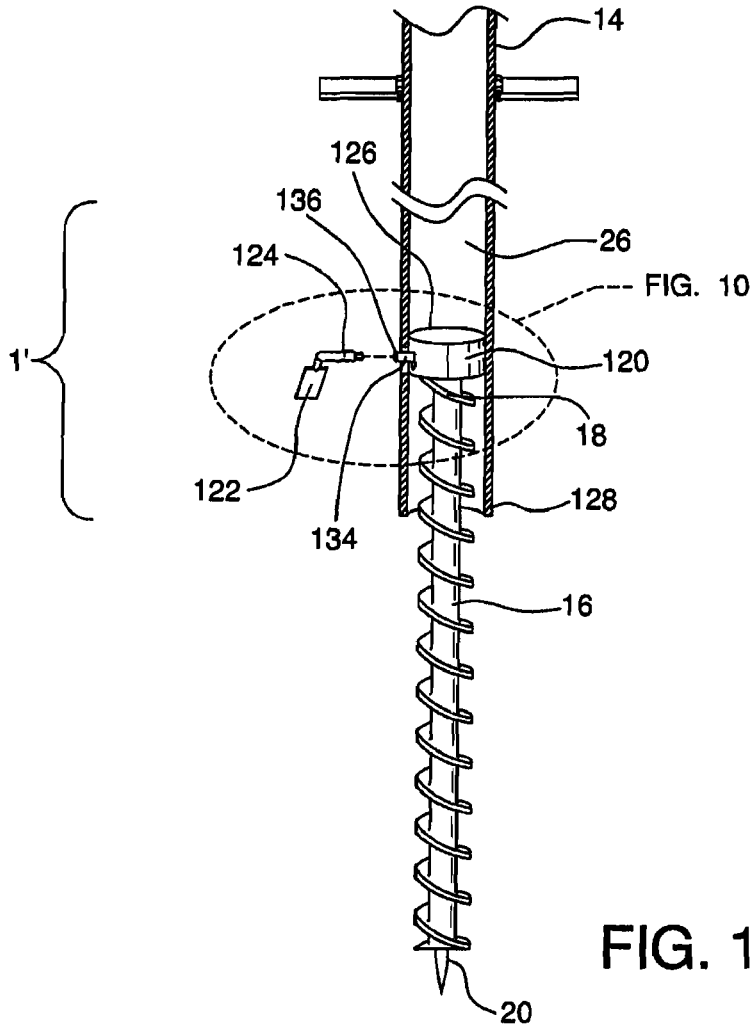
FIG. 11 is a partial cross-sectional view of an alternate embodiment of an umbrella stand according to the present invention.

In another embodiment of the present invention, shown in FIGS. 11 and 12, the foot operated drive assembly 1' is provided as a ratchet assembly provided as a self-contained unit 126 or cover. The unit 126 houses a ratchet assembly such as ratchet assembly 30 as described above, or any other acceptable ratchet mechanism. The drive shaft 134 in this or any other embodiment may be provided with a bolt opening 136 for receiving a bolt end, for example, a hex bolt. According to that variation, the foot pedal 122 has an extension 124 that has a bolt end 138, such as a hex bolt end. Inserting the bolt end 138 into the bolt opening 136 of the drive shaft 134 will allow the ratchet assembly to be operated by a user's foot. In addition, the drive shaft 134 may be contained completely within the unit 126, such that the extension 124 must be sized to reach the bolt opening 136 housed within the unit 126.

Figure 13:
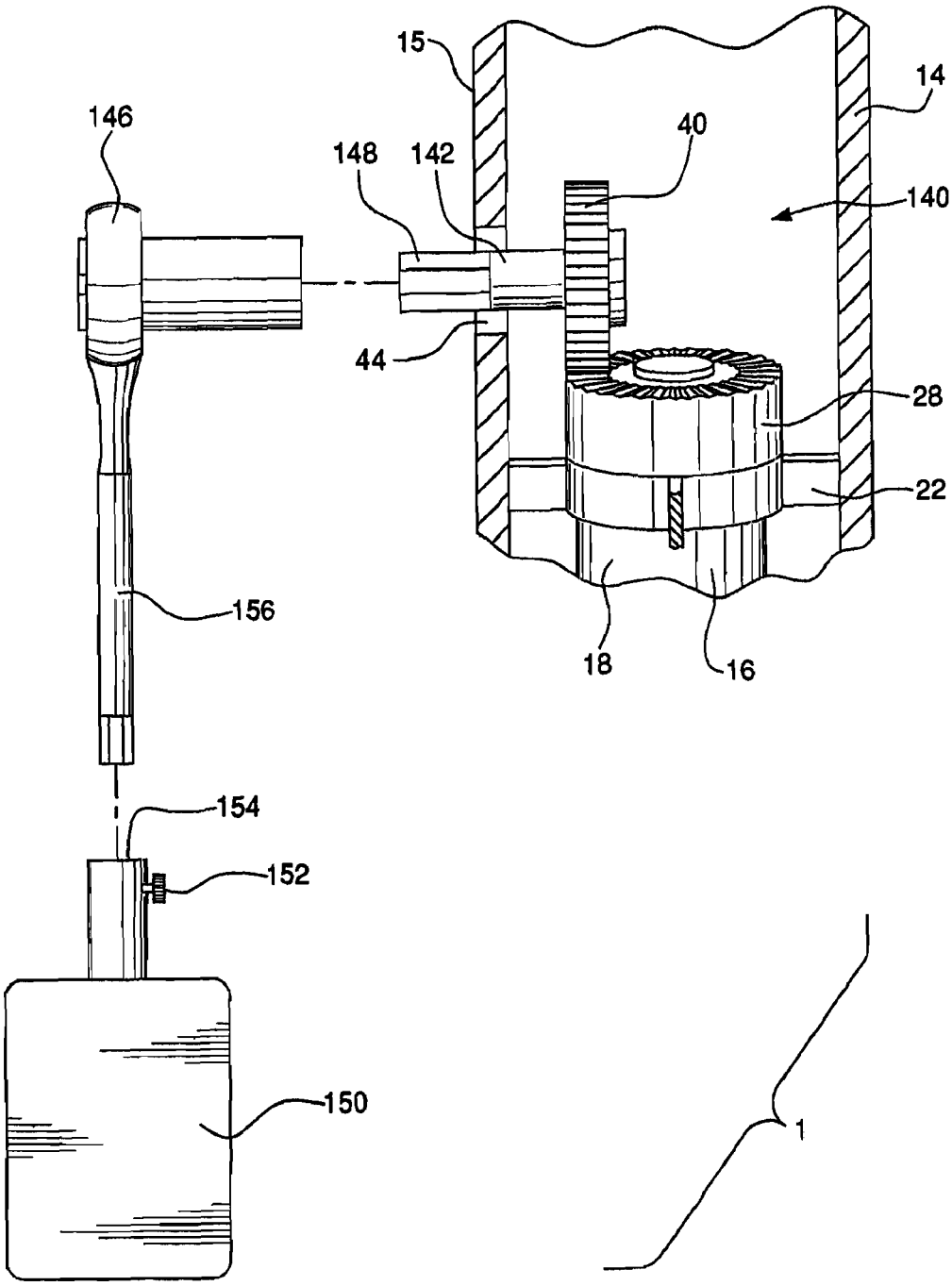
FIG. 13 is a partial cross sectional view of another embodiment of a foot operated assembly for assisting in insertion of a beach umbrella stand into the sand.

In yet another embodiment of the present invention, as shown in FIG. 13, a gear assembly 140 is provided, including a drive gear 40 that engages and rotates an auger gear 28 positioned at the top of an auger 16. The drive gear 40 has a shaft 142 extending through an opening 44 in the pole wall 15. The shaft 142 and drive gear 40 are rotatable about a central longitudinal axis. The shaft 142 and drive gear 40 may be secured in place by a collar, bracket, or other means. Rotation of the shaft 142 rotates the drive gear 40, which in turn rotates the auger gear 28. The shaft 142 has a drive end 148 which is preferably in the shape of a standard a hexagonal bolt head.

In this embodiment, a ratchet wrench 146 is used to rotate the drive end 148. A pedal adaptor 150 is provided for engaging the ratchet wrench 146, so that the ratchet wrench 146 can be operated by a user's foot be stepping on the pedal adaptor 150. The pedal adaptor 150 is provided with an open end 154 for engaging the handle 156 of the ratchet wrench 146. A set screw 152 or other securing or connecting means may be provided for securing the pedal adaptor 150 to the handle 156 of the ratchet wrench 146. A user can set the ratchet wrench 146 to turn in the desired direction, and operate the ratchet wrench 146 by stepping on the pedal adaptor 150, thus causing the auger 16 to turn in either direction, to either secure the beach umbrella stand 12 in the sand 56, or to remove the beach umbrella stand 12 from the sand 56.

It is appreciated that, although shown in use in connection with a beach umbrella, the foot operated drive assembly of the present invention may be adapted for use in connection with any pole or stand used for anchoring or securing objects to the ground (dirt, soil or sand). For example, the foot operated drive assembly of the present invention may be used with or incorporated into a picnic umbrella pole, volleyball or badminton net pole, mailbox stand or pole, or other objects.

Having thus described in detail several embodiments of the present invention, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What we claim is:

1. A beach umbrella stand having a foot operated drive assembly, comprising:

a pole including a hollow interior portion;

an auger mounted at least partially within the hollow interior portion;

a foot operated drive assembly operably engaging the auger and comprising a ratchet assembly.

2. The beach umbrella stand according to claim 1, wherein the drive assembly further comprises a pedal, and wherein the pedal is positioned at a height whereby a knee of an operator of the pedal is not raised above the operator's waist when the operator raises a foot to operate the pedal.

3. The beach umbrella stand according to claim 1, wherein the pole has a top end and a bottom end, wherein the drive assembly further comprises a pedal, and wherein the pedal is positioned at a height at or below about two feet from the bottom end of the pole.

4. The beach umbrella stand according to claim 1, wherein the ratchet assembly is a reversible ratchet assembly.

5. A beach umbrella stand having a foot operable operated drive assembly for operation by a user, comprising:

a pole including a hollow interior portion;

an auger mounted at least partially within the hollow interior portion;

a foot operated operable drive assembly operably engaging the auger, the drive assembly including a ratchet assembly, the drive assembly including a pedal, the auger moveable in response to operation of the pedal.

6. The beach umbrella stand according to claim 5, wherein the ratchet assembly is positioned at a height whereby a knee of an operator of the pedal is not raised above the operator's waist when the operator raises a foot to operate the pedal.

7. The beach umbrella stand according to claim 5, wherein the pole has a top end and a bottom end, and wherein the ratchet is positioned at a height at or below about two feet from the bottom end of the pole.

8. The beach umbrella stand according to claim 5, wherein the ratchet assembly is a reversible ratchet assembly.

9. A beach umbrella stand having a foot drive assembly, comprising:

a pole including a hollow interior portion;

an auger mounted at least partially within the hollow interior portion;

a foot operated drive assembly operably engaging the auger, the drive assembly including a pedal, the auger moveable in response to operation of the pedal.

* * * * *